US005282425A

United States Patent [19]

Timan

[11] Patent Number: 5,282,425

[45] Date of Patent: Feb. 1, 1994

[54] LOW LATERAL STIFFNESS CYLINDRICAL BUSH

[75] Inventor: Peter Timan, Sydenham, Canada

[73] Assignee: Bombardier Inc., Canada

[21] Appl. No.: 896,657

[22] Filed: Jun. 10, 1992

[51] Int. Cl.[5] ..... B61F 5/00

[52] U.S. Cl. ..... 105/168

[58] Field of Search ..... 105/168, 167, 166, 165

[56] References Cited

U.S. PATENT DOCUMENTS

| | | | |
|---|---|---|---|
| 3,528,374 | 9/1970 | Wickens | 105/168 |
| 4,285,280 | 8/1981 | Smith | 105/168 |
| 4,429,637 | 2/1984 | Jackson et al. | 105/168 |
| 4,802,418 | 2/1989 | Okamoto et al. | 105/168 |
| 5,123,357 | 6/1992 | Fujita et al. | 105/168 |

FOREIGN PATENT DOCUMENTS

| | | |
|---|---|---|
| 0116235 | 8/1984 | European Pat. Off. . |
| C250285 | 9/1912 | Fed. Rep. of Germany . |

*Primary Examiner*—Mark T. Le

*Attorney, Agent, or Firm*—Ladas & Parry

[57] ABSTRACT

A steerable truck has a pair of wheelsets supporting a pair of laterally spaced side frames. Each wheelset is connected to the sideframe at one end by a pivotal connection and at the opposite end through a steering link to provide relative displacement between the wheelset and sideframe. The connections between the wheelsets and sideframes include upper and lower pivots. One of the pivots has a lower lateral stiffness than longitudinal stiffness to allow movement of the associated wheelset out of plane without inducing torsional loads in the sideframe.

16 Claims, 5 Drawing Sheets

LOW LATERAL STIFFNESS CYLINDRICAL BUSH

The present invention relates to trucks.

Railroad trucks conventionally comprise a pair of sideframes that are supported on spaced wheelsets and connected to the rail vehicle by means of a bolster extending between the sideframes. The truck can usually pivot about a vertical axis relative to the vehicle to accommodate curves in the track. Curving of the truck is enhanced by utilizing conical wheels so that the different rolling radiuses accomodate the different running length of the rails around the curve and maintain the truck centered.

In applications requiring a tighter radius of curvature than that which is available from a conventional truck, it is known to steer the wheelsets of the truck so that they adopt a radial position with respect to the curve of the track. Steering inputs are provided from the relative movement between the truck and the vehicle body as the truck enters the curve to produce a forced steering. Many designs of steerable truck have been proposed but a particularly beneficial one is shown in U.S. Pat. No. 4,285,280 to Roy E. Smith. In this arrangement, sliding between the wheelsets and the sideframes during steering motion is avoided by providing a steering lever pivoted to both the sideframe and the bearing assembly supporting the axle. The pivots are offset so that rotation of the steering lever causes a displacement of the axle to effect the steering motion. This enables the steering action to be accomplished through pivotal motion between the sideframes and the components of the wheelset and increases the stability of the truck.

In the arrangement shown in the above U.S. patent, the pivots between the bearing housing, steering lever and sideframe are formed from roller bearings. As such, the bearing assembly and steering lever are secured at vertically-spaced locations so as to be able to transfer the vertical loads from the sideframe to the wheels and to accommodate the steering motions of the axle. The wheelset is also supported at the opposite sideframe by either a similar arrangement or by a single pivotal connection between the bearing housing and the sideframe depending upon the particular configuration of steerable truck chosen. In each case, however, the connections between the sideframes and the wheelset are rigidly secured in both the longitudinal and lateral directions. The longitudinal stiffness is necessary to locate the steering axis accurately and also to be able to transmit torque loads through the axle as may be induced through braking or power transmission if a rotary drive is utilized.

As a result of these considerations, the wheelset is connected to the sideframe by four fixed pivot points both in the lateral direction and in the longitudinal direction of the sideframe. Consequently, the torsional stiffness of the truck is relatively high that is, there is a relatively high resistance to the movement of one wheel vertically out of the plane of the other three. A high torsional stiffness is generally undesirable as it is conventional practice to bank curves of a track. This means that the outer rail of the track adopts a spiral configuration as it enters the curve and with a torsionally stiff truck there will be a tendency to unload one of the wheels of the truck. Moreover, with the torsionally stiff connection about a longitudinal axis between the wheelset and the sideframes, any twisting out of the horizontal plane between the axles must be accommodated within the sideframe itself. This means that the sideframe must be dimensioned to withstand the torsional loads induced in it and this in turn results in a heavier sideframe than would otherwise be necessary.

The stiffness of the truck could be reduced by introducing resilient connections between the sideframes and the wheelsets while retaining the pivotal connections. However to achieve the steering motion, the sideframe is supported eccentrically on the bearing assembly. By introducing flexibility into the pivot connections, vertical loads cause a moment about the longitudinal axis to be applied to the steering lever assembly. This is balanced by an equal and opposite moment provided by equal and opposite lateral forces induced in the vertically spaced pivot connections between the sideframe and steering lever. This causes an angular deflection between the steering lever and sideframe which loads the wheelset bearings in torsion about a longitudinal axis. This is generally undesirable and is accentuated by the high lateral stiffness at each of the pivot connections.

It is therefore an object of the present invention to provide a truck in which the above disadvantages are obviated or mitigated.

According to the present invention, there is provided a steerable truck having a pair of laterally spaced sideframes supported at spaced locations on a pair of wheelsets with at least one of said wheelsets being adjustable about a vertical steering axis relative to said sideframes to effect steering of the truck, said one wheelset including an axle having a pair of spaced bearing assemblies supporting respective ones of said sideframes to permit rotation of the axle about a transverse horizontal axis, each of said bearing assemblies including upper and lower pivot means to permit relative movement between the sideframe and bearing assembly about respective vertical axes to accomodate steering of the one wheelset, one of said pivot means of one of said assemblies exhibiting a lower stiffness in a lateral direction than in a longitudinal direction to facilitate torsional movement between the housing and the associated sideframe about a horizontal longitudinal axis.

In general terms, therefore, one of the pivots between the bearing assembly and the sideframe is arranged to have a differential stiffness between the longitudinal and lateral directions. This allows torsional flexibility of the truck by accommodating lateral movement and effectively supporting the sideframe at a single pivot point in the lateral direction at one end. This prevents a significant moment being induced in the sideframe or bearing. However, the longitudinal stiffness necessary to control the steering axis and transfer torque loads is maintained. It is preferred that the differential stiffness is provided through an elastomeric bush having a higher radial stiffness over a portion of its circumference than over the balance of the circumference.

It is preferred that a diagonal brace extends between the sideframes and that the wheelsets are pivoted to the sideframes adjacent the connection of the brace. The opposite end of each wheelset is then moveable by the steering lever and it is preferred to provide the bushing with a differential stiffness at the steering location.

This maintains the interaxle shear stiffness introduced by the brace and so prevents a deterioration in the dynamic performance of the truck.

It is preferred that the brace is aligned to intersect the pivot axes at diagonally opposite locations and thus inhibit the generation of significant lateral forces at the steered end of the sideframe.

An embodiment of the invention will now be described by way of example only with reference to the accompanying drawings, in which FIG. 1 is a plan view of a steerable truck;

Figure 1:
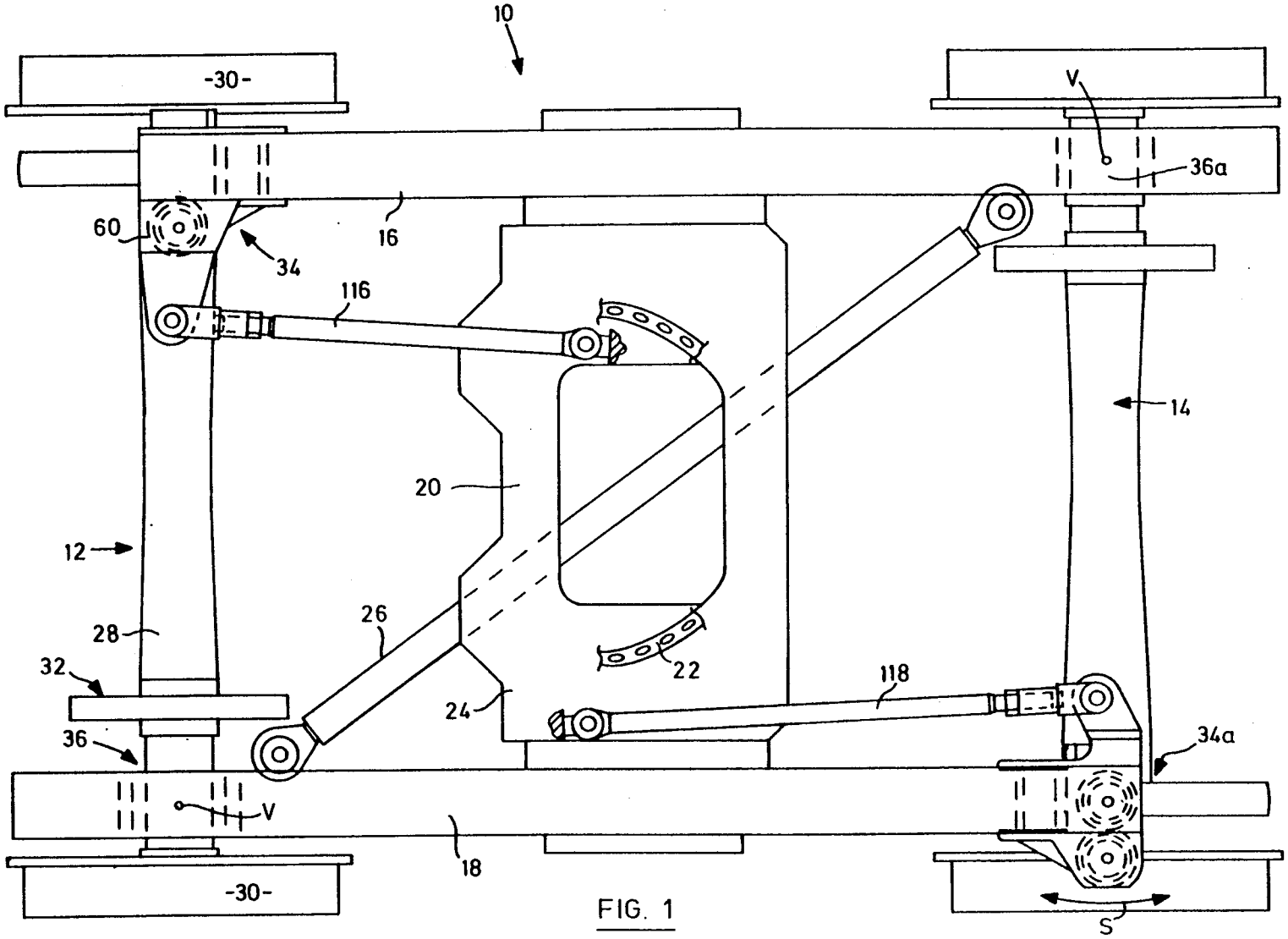

Referring therefore to FIG. 1, a truck 10 includes a pair of wheelsets 12,14 that are spaced apart along the longitudinal axis of the truck and support a pair of laterally spaced sideframes 16, 18. A bolster 20 is supported on the sideframes for connection to the vehicle body through a slewing ring 22. The slewing ring 22 is located between the bolster 20 and a top plate 24 that is connected to the vehicle so that rotation of the truck 10 relative to the vehicle can be accomodated about a vertical axis.

Each of the Wheelsets 12,14 includes an axle 28 having wheels 30 mounted at opposite ends. The wheels 30 are of the conventional flanged form with a frustoconical tread to provide a self-centering action as they run along the rails. A brake assembly 32 is also located on each of the axles that co-operates with a brake calliper (not shown).

Figure 2:
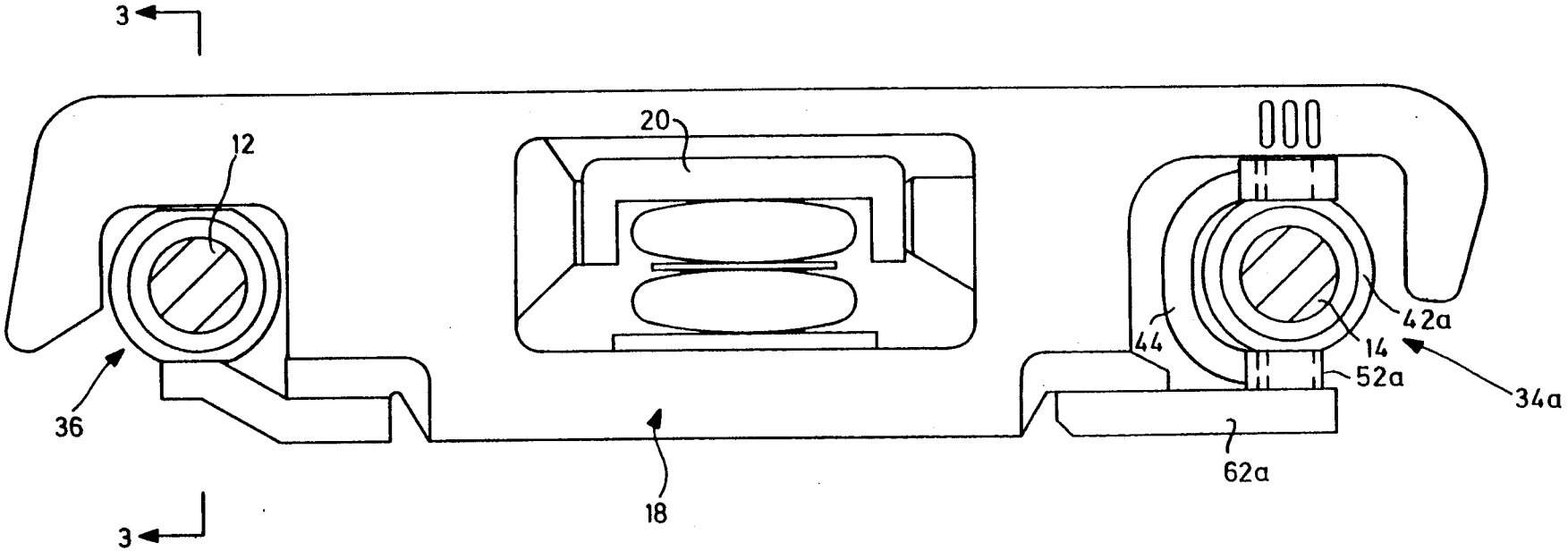
FIG. 2 is a side view of the truck shown in FIG. 1.
Figure 3:
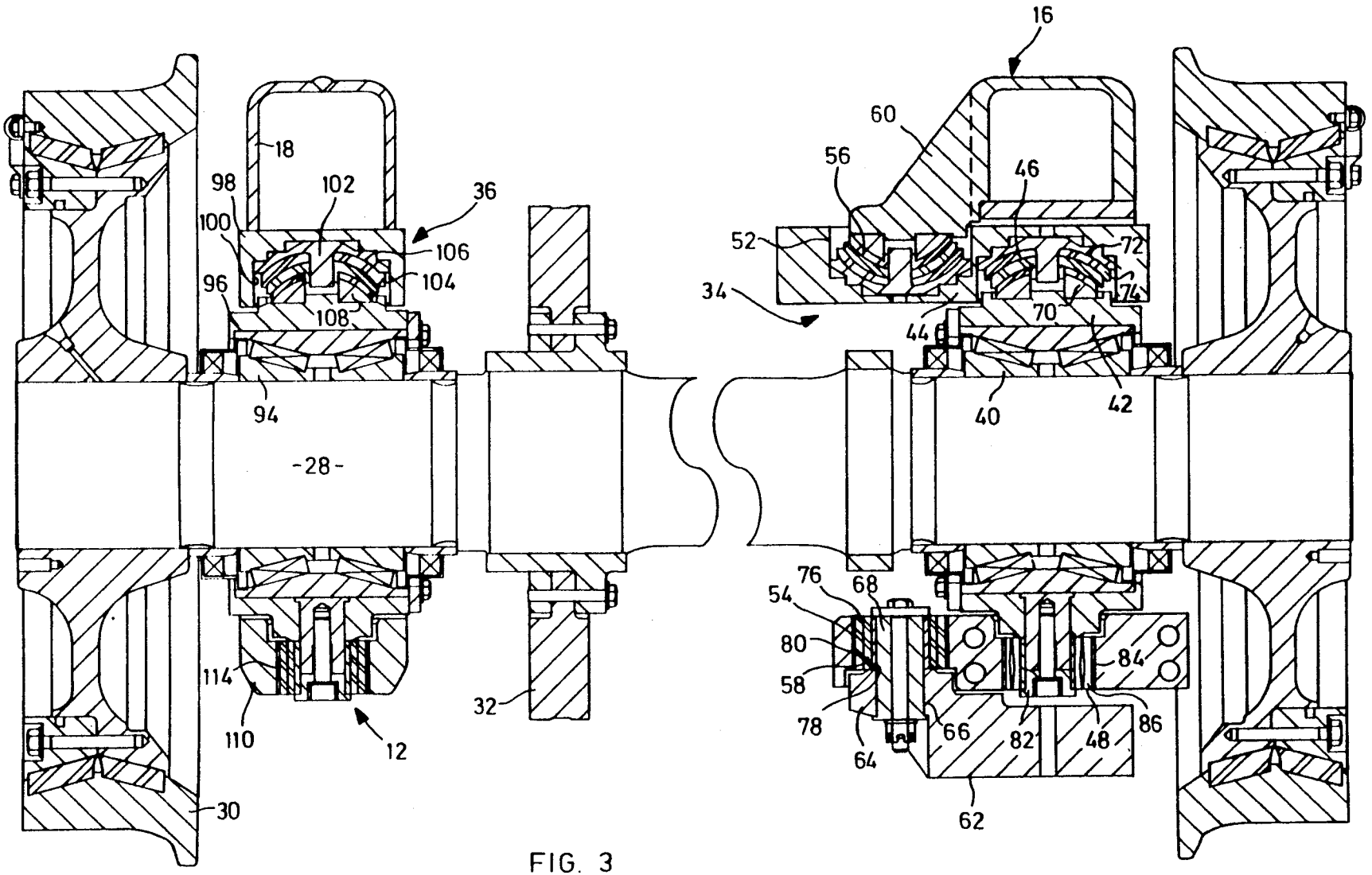
FIG. 3 is a view on the line 3—3 of FIG. 2.
Figure 4:
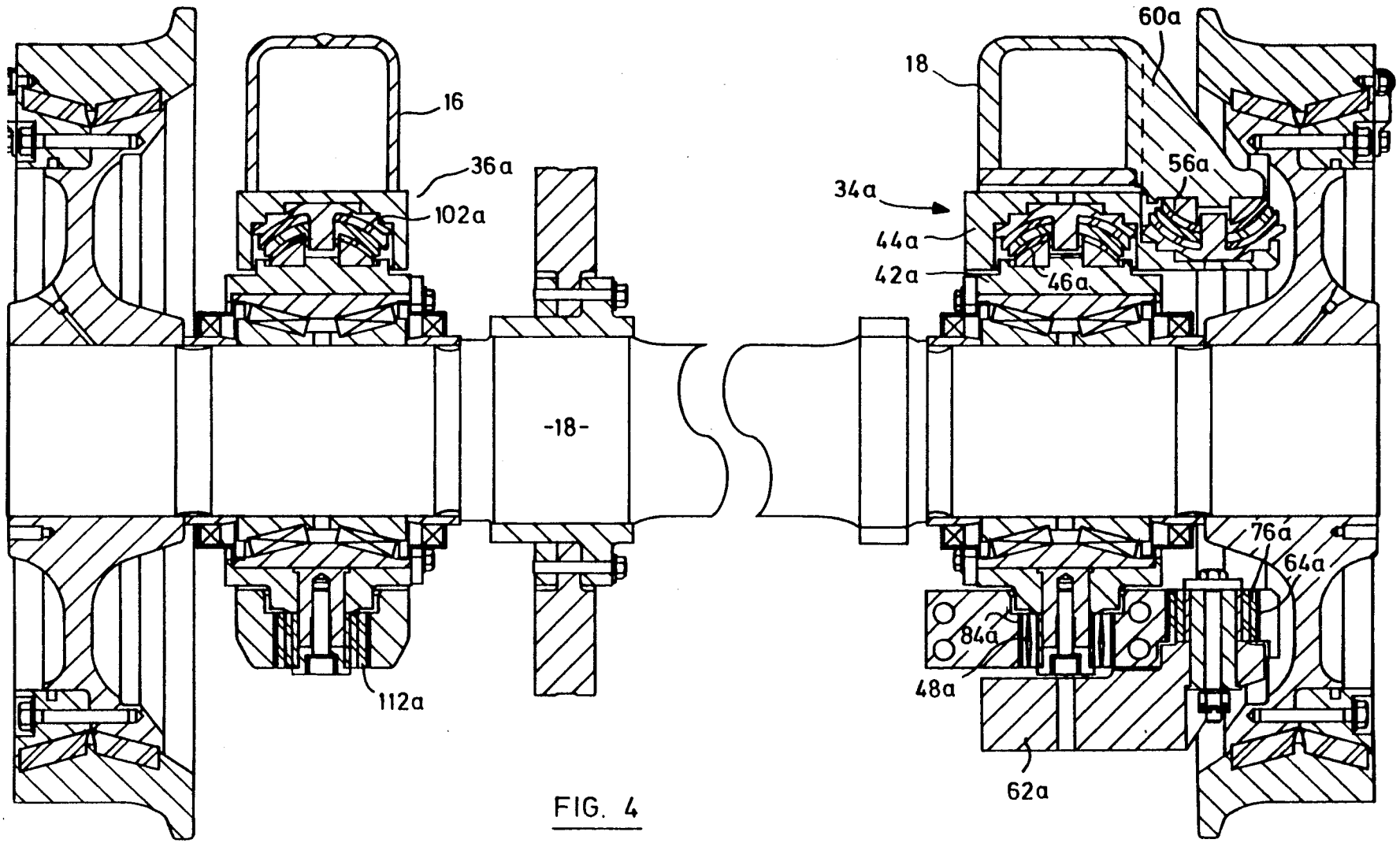
FIG. 4 is a view on the line 4—4 of FIG. 2.

As best seen in FIGS. 2 and 3, the wheelset 12 is connected to the sideframes 16,18 through bearing assemblies 34 36 respectively and the wheelset 14 is connected to the sideframes 16,18 by bearing assemblies 34*a*, 36*a* respectively. In the arrangement of truck shown in FIG. 1, one end of each axle is fixed to a respective sideframe to pivot about a fixed vertical axis, indicated at V, and the opposite end is longitudinally displaceable relative to the sideframe as indicated by the arrow 'S'. The fixed vertical axes V are located at diagonally opposite locations so that each wheelset 12,14 is moved longitudinally in the same direction on opposite sides of the truck 10 to achieve steering. As such, the configuration of the bearing assemblies 34, 34*a*, 36, 36*a* associated with each of the wheelsets 12,14 is similar but certain changes are made between the outboard and inboard wheelsets to achieve the desirable steering action. The outboard wheelset 12 is shown in FIG. 3 and the inboard wheelset 14 is illustrated in FIG. 4.

Shear stiffness for the truck is provided by a diagonal link 26 pivotally secured at opposite ends to the sideframes 16, 18. The diagonal link 26 is aligned such that its line of action substantially extends through the pivot points V of the bearing 36 to its bearings 36,36*a* to the respective sideframe. This alignment of the link 26 prevents lateral bending loads being induced in the sideframes at the steered end of the sideframes as a result of interaxle shearing forces.

Referring therefore to FIG. 3, the bearing assembly 34 provides for relative longitudinal displacement between the side frame 16 and wheelset 12 and includes a pair of tapered roller bearings 40 located in a bearing housing 42 to allow rotation of the axle 28 about a transverse horizontal axis. Bearing housing 42 is located in a steering lever 44 by upper and lower pivots 46,48 respectively. As best seen in FIG. 2, the steering lever 44 is formed as a C-shaped yoke that extends around the bearing housing 42 and terminates in upper and lower bosses 50,52 to receive the upper and lower pivots 46,48. The opposite ends of the steering lever 44 also extend laterally inwardly to provide bosses 52,54 that are offset to one side of the upper and lower pivots 46,48. The bosses 52,54 each receive a bearing 56,58 to pivotally connect the steering lever 44 with the sideframe 16.

The sideframe 16 includes a boss 60 that projects laterally inwardly and is received within the boss 52. Similarly, the lower portion of sideframe 16 includes a forward extension 62 that is bolted to the underside of the sideframe 16 and includes an ear 64 that extends laterally inwardly toward the sideframe 18. Ear 64 has a central bore 66 that receives a pin 68 that also extends through the pivot 58 in boss 54.

The pivots 46 and 56 are each formed with a pair of opposed part-spherical surfaces 70,72 with elastomeric laminations 74 interposed between the surfaces. The part-spherical surfaces 70,72 permit the elastomeric lamination 74 to provide vertical, longitudinal and lateral stiffness while permitting relative rotation between the surfaces 70,72 about a vertical axis.

The lower pivot 54 is formed from an elastomeric bush 76 having inner and outer sleeves 78,80 which are received on the pin 68 and in the bore 54 respectively. The bush 76 has a uniform radial stiffness about its circumference and allows relative rotation between the extension 62 and the steering lever 44.

Figure 5:
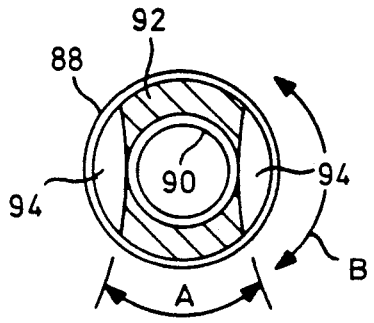
FIG. 5 is a component used in the truck shown in FIGS. 1 to 4.

The pivot 48 is located between a pin 82 secured to the housing 40 and a bore 84 formed in the steering lever 44. An elastomeric bushing 86 is located between the pin 82 and the bore 84 and exhibits a lower lateral stiffness than longitudinal stiffness. The form of the bushing is best seen in FIG. 5 and has an outer sleeve 88 and an inner sleeve 90 for engagement with the bore and pin respectively. An elastomeric web 92 separates the sleeves 88,90 but does not extend uniformly about the circumference of the sleeve 90. It will be noted that voids 94 are formed at diametrically opposed locations so that the radial stiffness over the portion of the circumference denoted by the arc A is significantly greater than that over the portion denoted by the arc B. With the bushing installed and the web 92 orientated in the longitudinal direction, longitudinal loads between the steering lever and the sideframe will tend to place one of the webs in compression and the other in tension. However, lateral loads will tend to place the web 92 in shear and so a differential stiffness is obtained. It is preferred that the lateral stiffness should be as low as possible and in practical terms can be between 10% and 20% of the longitudinal stiffness.

The bearing assembly 36 is of significantly simpler construction than 34 and includes a pair of tapered roller bearings 94 located within a housing 96. The sideframe 18 includes a casting 98 that has a central cavity 100 to receive a pivot 102. The pivot is similar in construction to the pivot 46 having elastomeric laminations 104 located between opposed part-spherical surfaces 106,108. The laminations 104 thus are able to accommodate vertical, lateral and longitudinal loads while allowing pivotal movement between the opposed surfaces 106,108. The bearing housing 96 is located on an extension 110 bolted to the sideframe 18 through a pivot 112 similar in configuration to the pivot 54 having an elastomeric bushing 114. The axle 28 may thus pivot about a vertical axis relative to the sideframe 18 by virtue of the pivots 102,112 to allow steering motion of the wheelset 12 relative to the sideframes.

The inboard wheelset shown in FIG. 4 is similar in construction to the outboard wheelset shown in FIG. 3 and therefore like reference numerals will be used to denote like parts with the suffix "a" added for clarity. In view of the similarity of the constructions, a detailed explanation of the wheelset will not be given except to note that the boss 60a extends laterally outwardly from the sideframe 18 so that the pivot 56 is laterally outboard of the pivot 46. Similarly, the extension 62 is located laterally outwardly of the bearing assembly 40 so that the pivot connection 54a is laterally outwardly of the pivotal connection 48a. A similar bush 86a to that shown in FIG. 5 is utilized at the pivot 48a to have a lower lateral stiffness than longitudinal stiffness.

As shown in FIG. 1, the steering levers 44,44a are each connected to the support plate 24 on opposite sides of the axis of rotation of the slew ring 22 by means of tie rods 116,118. Thus, as the truck enters a curve, the outboard wheelset 12 is centered by the conicity of wheels 30 and causes relative rotation between the vehicle body and the truck. This causes rotation of the plate 24 about the slew ring 22 to move the tie rods 116,118 longitudinally but in opposite directions. The tie rods rotate their respective steering levers 44,44a relative to the sideframes 16,18 about the pivots 56,58 and 56a,58a so that the bearing assembly is longitudinally displaced relative to the respective one of the sideframes. The displacement is accommodated by rotation of the bearing housing 42 about the vertical pivots 46,48 and by rotation of the bearing assembly 36 relative to the sideframe 18 by virtue of the pivots 102,112. The wheelsets 12,14 thus adopt a radial position relative to the track to avoid flange contact with the rail.

During the steering action of the wheelsets 12,14, the elastomeric elements accommodate the relative rotation about the vertical axes. In this manner, relative sliding between opposed surfaces is avoided to maintain the benefits inherent in the steering system.

It will be noted from FIGS. 3 and 4 that the pivots 46, 48, 102 and 112 constrain relative motion between the bearing assemblies 34,36 and their respective sideframes 16,18. Thus, a longitudinal disturbance will be opposed by each of the elastomeric elements in the pivots to provide the required stiffness. However, it will also be noted by virtue of the lower lateral stiffness of the bush 86 in the pivots 48 and 48a that elevation of one wheel relative to the other, for example when entering a portion of spiral track, will allow the sideframes 16,18 to tilt with respect to the bearing assemblies 34,34a. The bushings 86,86a allow a lateral displacement of the pins 82,82a relative to the respective steering levers 44, 44a so that torsional loads are not induced between opposite ends of the respective sideframe 16,18. Thus, the lower lateral stiffness in the pivots 48, 48a decreases the torsional stiffness of the truck 10 without reducing the vertical load carrying capacity of the longitudinal stiffness between the wheelsets.

It will be apparent that the lower lateral stiffness bushing 86 could be incorporated in the pivot 112 to achieve a similar effect of unloading torsional stresses in the sideframe 16,18. However, it is believed that the location in the assembly 34 is preferred as it also accommodates the eccentric loads induced by the offsetting of the pivot 58 from the pivot 46.

It is also preferred that the link 26 is connected to the sideframe adjacent to the bearing that does not include the bushing 86. This avoids significant torsional loads being induced in the sideframe by the bracing action of link 26 as would be the case if the link 26 was connected adjacent to bushing 86 due to the reduced lateral stiffness.

We claim:

1. A steerable truck having a pair of laterally spaced sideframes supported on a pair of wheelsets spaced apart along a longitudinal axis of said truck with at least one of said wheelsets being adjustable about a vertical steering axis relative to said sideframes to effect steering of the truck, said one wheelset including an axle having a pair of spaced bearing assemblies supporting respective ones of said sideframes to permit rotation of the axle about a transverse horizontal axis, each of said bearing assemblies including upper and lower pivot means to permit relative movement between the sideframe and wheelset about respective vertical axes to accommodate steering of the one wheelset, one of said pivot means of one of said assemblies exhibiting a lower stiffness in a lateral direction normal to said longitudinal axis than in a longitudinal direction parallel to said longitudinal axis to facilitate torsional movement between the wheelset and the associated sideframe about a horizontal axis parallel to said longitudinal axis.

2. A truck according to claim 1 wherein said one bearing assembly includes a bearing housing and a steering lever, each of said pivot means including a first pivot acting between said lever and said housing and a second pivot spaced from said first pivot and acting between said lever and said sideframe, one of said pivots of one of said pivot means having a lower stiffness in said lateral direction than in said longitudinal direction.

3. A truck according to claim 2 wherein each pivot of the other of said pivot means transfers vertical loads between said axle and said sideframe.

4. A truck according to claim 3 wherein said one pivot is located in said lower pivot means between said bearing housing and said steering lever.

5. A truck according to claim 2 wherein said one pivot is an elastomeric bush whose radial stiffness varies about the circumference thereof.

6. A truck according to claim 5 wherein the radial stiffness of the bush in said lateral direction is between 10% and 20% of the radial stiffness in said longitudinal direction.

7. A truck according to claim 3 wherein the pivots of said other pivot means are elastomeric bushes to accommodate axial and torsional loads.

8. A truck according to claim 7 wherein said other pivot means are part-spherical elastomeric bushes.

9. A truck according to claim 1 wherein each of said wheelsets is steerable and each includes an axle having a pair of spaced bearing assemblies supporting respective ones of said sideframes to permit rotation of the axle about a transverse horizontal axis, each of said bearing assemblies including upper and lower pivot means to permit relative movement between the sideframes and bearing assembly about respective vertical axes to accomodate steering of the one wheelset, one of said pivot means of one of said assemblies of each wheelset exhibiting a lower stiffness in said lateral direction than in said longitudinal direction to facilitate torsional movement between the housing and the associated sideframe about a horizontal axis parallel to said longitudinal axis.

10. A truck according to claim 9 wherein said one bearing assembly of one of said wheelsets is associated with one of said sideframes and said one bearing assembly of the other of said wheelsets is associated with the other sideframe.

11. A truck according to claim 10 wherein each of said one bearing assemblies includes a bearing housing and a steering lever, each of said pivot means including a first pivot acting between said lever and said housing and a second pivot spaced from said first pivot and acting between said lever and said sideframe, one of said pivots of one of said pivot means having a lower lateral stiffness than longitudinal stiffness.

12. A truck according to claim 1 wherein a brace extends between said side frames and is inclined to the longitudinal axis of said truck to provide shear stiffness between said sideframes.

13. A truck according to claim 10 wherein each of said one bearing assemblies includes a bearing housing and a steering lever, each of said pivot means including a first pivot acting between said lever and said housing and a second pivot spaced from said first pivot and acting between said lever and said sideframe, one of said pivots of one of said pivot means having a lower stiffness in said lateral direction than in said longitudinal direction.

14. A truck according to claim 11 wherein a brace extends between said sideframes and is aligned to provide a line of action passing through the other bearing assembly of each wheelset.

15. A truck according to claim 14 wherein the other bearing assembly is pivotally connected to its respective sideframe.

16. A truck according to claim 14 wherein said brace is a link extending between said sideframe and secured thereto adjacent said other bearing assembly.

* * * * *